US009540888B2

(12) United States Patent
Reimert

(10) Patent No.: US 9,540,888 B2
(45) Date of Patent: Jan. 10, 2017

(54) WEAR BUSHING FOR LOCKING TO A WELLHEAD

(75) Inventors: Larry E. Reimert, Houston, TX (US); Denise A. M. Antunes, legal representative, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 13/635,077

(22) PCT Filed: Jul. 8, 2011

(86) PCT No.: PCT/US2011/043290

§ 371 (c)(1), (2), (4) Date: Sep. 14, 2012

(87) PCT Pub. No.: WO2012/047350

PCT Pub. Date: Apr. 12, 2012

(65) Prior Publication Data

US 2013/0213661 A1 Aug. 22, 2013

Related U.S. Application Data

(60) Provisional application No. 61/390,816, filed on Oct. 7, 2010.

(51) Int. Cl.

| | |
|---|---|
| ***E21B 21/00*** | (2006.01) |
| ***E21B 23/00*** | (2006.01) |
| ***E21B 7/12*** | (2006.01) |
| ***E21B 17/10*** | (2006.01) |
| ***E21B 33/043*** | (2006.01) |

(52) U.S. Cl.
CPC ..... *E21B 17/1007* (2013.01); *E21B 33/043* (2013.01)

(58) Field of Classification Search
None
See application file for complete search history.

(56) References Cited

U.S. PATENT DOCUMENTS

| | | | | |
|---|---|---|---|---|
| 4,019,580 | A * | 4/1977 | Garrett | E21B 33/043 166/120 |
| 4,289,026 | A * | 9/1981 | Neumann | G01F 23/226 200/61.04 |
| 4,289,206 | A * | 9/1981 | Kirkland | E21B 33/047 166/341 |
| 4,340,259 | A | 7/1982 | Green | |
| 4,362,210 | A | 12/1982 | Green | |
| 4,978,147 | A | 12/1990 | Henderson, Jr. et al. | |
| 5,025,864 | A | 6/1991 | Nobileau | |
| 5,199,495 | A | 4/1993 | Brammer et al. | |
| 5,360,063 | A | 11/1994 | Henderson, Jr. | |

(Continued)

*Primary Examiner* — Matthew R Buck
*Assistant Examiner* — Douglas S Wood
(74) *Attorney, Agent, or Firm* — Baker Botts L.L.P.

(57) ABSTRACT

A wear bushing (10) and a running tool (32) are provided for a subsea wellhead assembly including a wellhead housing and a casing hanger. The wear bushing is landed on the casing hanger, and a connector (16) axially connects the wear bushing and the wellhead housing. The running tool is actuated to connect the wear bushing, such that at least a portion of the connector is received within a corresponding recess in an interior wall of the wellhead housing. A bushing/casing hanger latch (18) axially connects the wear bushing and the casing hanger.

19 Claims, 8 Drawing Sheets

(56) References Cited

U.S. PATENT DOCUMENTS

| | | | | |
|---|---|---|---|---|
| 6,520,263 | B2 * | 2/2003 | June | E21B 33/043 166/348 |
| 6,739,398 | B1 * | 5/2004 | Yokley | E21B 23/01 166/123 |
| 6,945,325 | B2 * | 9/2005 | Ford | E21B 17/12 166/208 |
| 7,284,616 | B2 * | 10/2007 | Williams | E21B 17/1007 166/381 |
| 8,074,724 | B2 * | 12/2011 | Minassian | E21B 17/1007 166/382 |

* cited by examiner

WEAR BUSHING FOR LOCKING TO A WELLHEAD

CROSS REFERENCE TO RELATED APPLICATION

This application claims the priority of U.S. Provisional Application No. 61/390,816 filed on Oct. 7, 2010, the disclosure of which is incorporated herein by reference for all purposes.

FIELD OF THE INVENTION

This invention generally relates to subsea wellhead assemblies, and in particular to a wear bushing which positions drill pipe from engaging the casing hanger, the wellhead, and the casing near the hanger.

BACKGROUND OF THE INVENTION

When drilling a subsea wellhead, a wellhead housing will typically be located on the sea floor and a casing lowered into the well and cemented into place. A casing hanger is supported in the wellhead housing and is secured to the upper end of the casing. A drill bit and a drill string from a drilling vessel pass downward through the wellhead housing and casing hanger for further drilling operations.

Various types of wear bushings have been devised to land on the casing hanger and limit wear to the wellhead housing, the hanger, and the casing suspended from the hanger. Some prior art wear bushings are interconnected with the casing hanger, which is conventionally supported in place by the wellhead. Other wear bushings are connected to the casing hanger seal, which in turn is supported on the casing hanger. In some applications, the casing hanger may migrate upward in response to high fluid pressure below the hanger. Axial movement of the casing hanger and the wear bushing in response to fluid pressure in the well is detrimental to the overall purpose of the wear bushing, which is to reliably limit wear on the hanger and casing by the rotating drill pipe.

U.S. Pat. No. 5,199,495 discloses a split wear bushing which is supported on the casing hanger. U.S. Pat. No. 5,025,864 discloses a wear bushing that connects to the seal for the casing hanger. U.S. Pat. No. 5,360,063 discloses another type of wear bushing which is supported on the casing hanger. Other patents of interest include U.S. Pat. Nos. 4,362,210, 4,978,147, and 4,340,259.

The disadvantages of prior art overcome by the present invention, and improved wear bushing and running tool are hereinafter disclosed for connecting the wear bushing to the wellhead.

SUMMARY OF THE INVENTION

In one embodiment, a wear bushing and running tool are provided for a subsea well assembly including the wellhead housing and casing hanger. The wear bushing is removably supported in the wellhead for minimizing damage to the wellhead housing, the casing hanger, and the casing during drilling operations. A bushing/wellhead housing connector axially connects the wear bushing to the wellhead housing. The retrievable running tool is actuated to connect the bushing to the wellhead housing, such that at least a portion of the connector is received within a corresponding groove or recess in an interior wall of the wellhead housing. A bushing/casing hanger connector may also axially connect the wear bushing and the casing hanger.

These and further features and advantages of the present invention will become apparent from the following detailed description, wherein reference is made to the figures in the accompanying drawings.

DETAILED DESCRIPTION OF PREFERRED EMBODIMENTS

Figure 1:
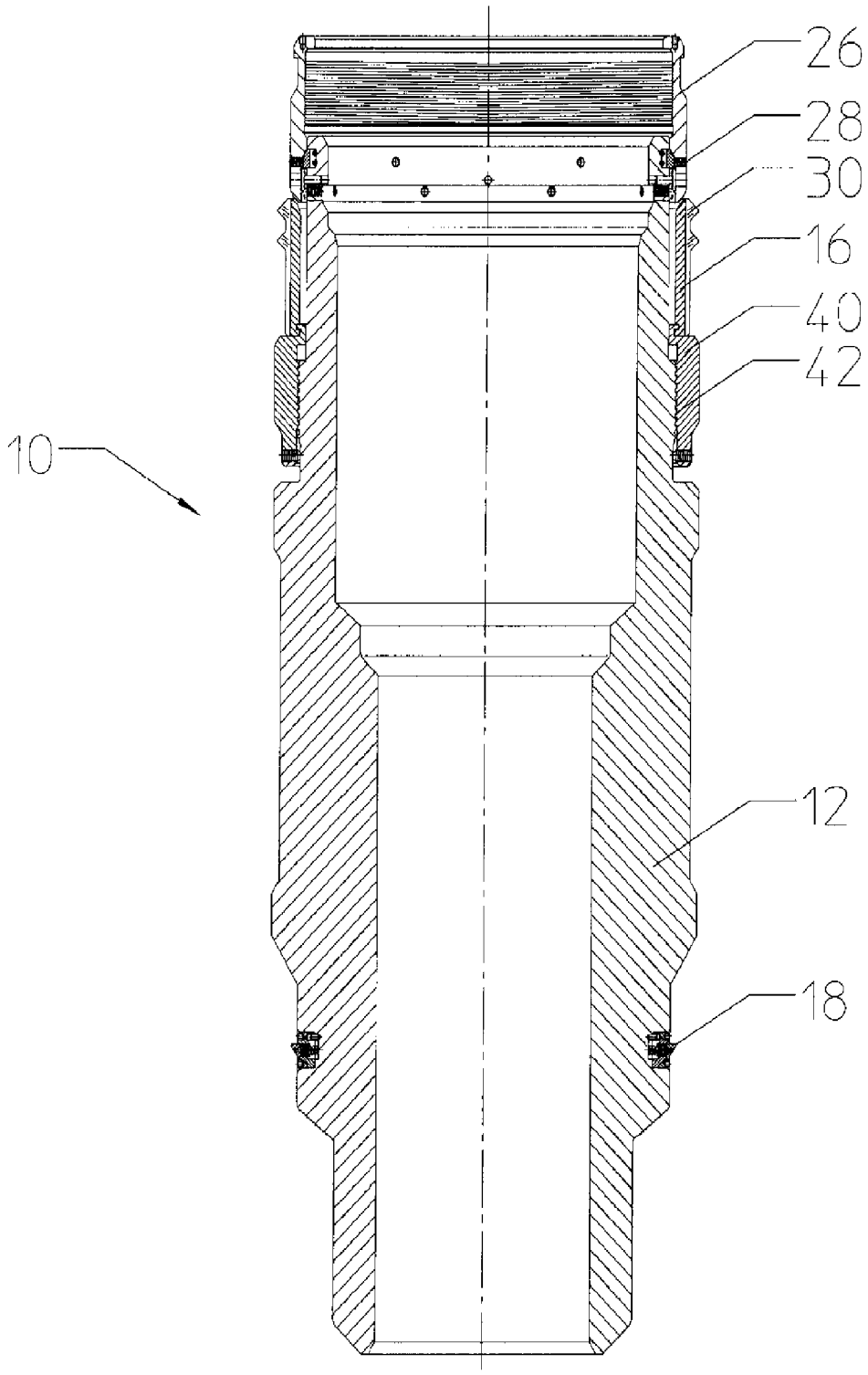
FIG. 1 is a cross-sectional view of a suitable wear bushing.

FIG. 1 depicts a wear bushing 10 for landing on a casing hanger, which in turn is positioned within a subsea wellhead. During drilling operations, drill pipe passes through the bore in the casing hanger and rotates within the downhole casing. The purpose of the wear bushing is to minimize damage to the wellhead housing, the casing hanger, and the casing during rotation of the drill string. Wear bushing 10 as shown in FIG. 1 includes a main body or housing 12. Latch mechanism 16 is provided as the bushing/wellhead housing connector for axially connecting the wear bushing and the wellhead housing. A lower yield strength bushing/casing hanger connector 18 is provided near the lower end of the body 12 for interconnecting the wear bushing and the casing hanger, as explained further below.

Figure 5:
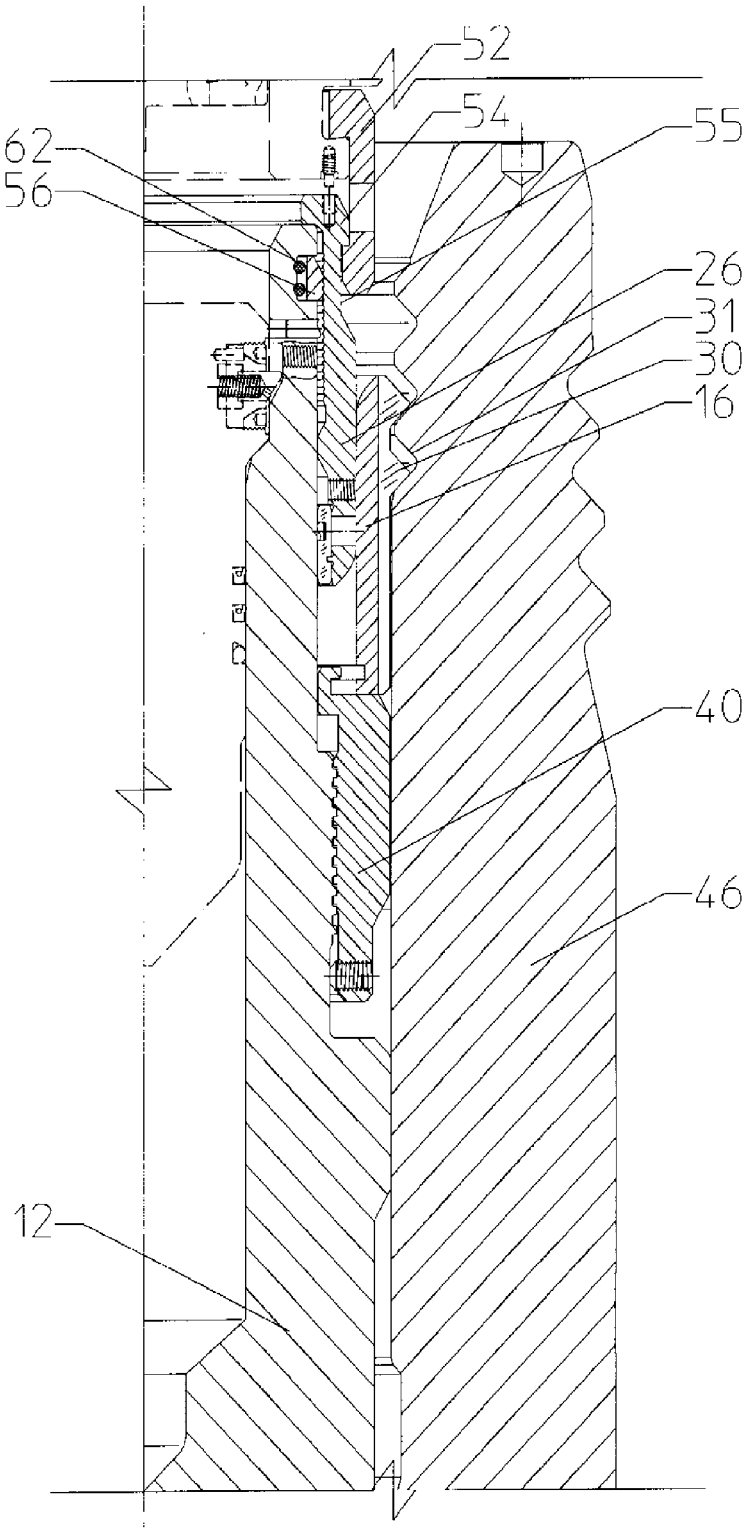
FIGS. 5, 6, and 7 illustrate a portion of the wear bushing shown in FIGS. 1-3, respectively, locked to the wellhead.

The wear bushing as shown in FIG. 1 includes nut 40 with threads 42 for mating with threads on the wear bushing body 12 to facilitate manufacturing and assembly of the wear bushing. Actuating sleeve 26 is shown pinned at 28 to body 12, and moves downward in response to the actuation of the running tool to shear pin 28 and force latch mechanism 16 radially outward to latch to the wellhead, as shown in FIG. 5.

Figure 2:
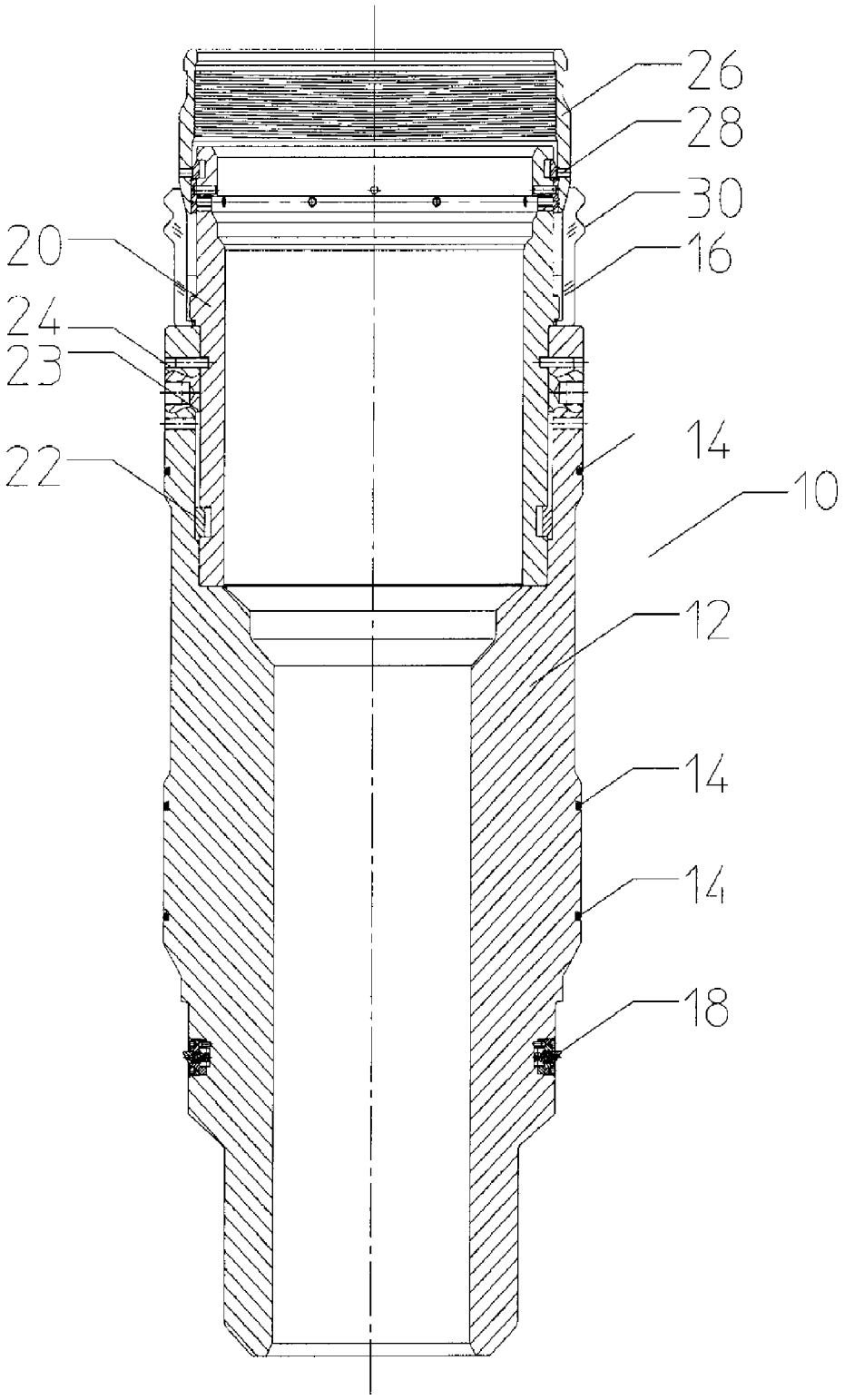
FIGS. 2 and 3 are each alternative embodiments of a wear bushing.

FIG. 2 depicts an alternate embodiment of a wear bushing 10 including an inner sleeve 20. A plurality of shear pins 24 connect the bushing body 12 to the inner sleeve 20. The actuating sleeve 26 is connected to the upper end of inner sleeve 20 by shear pins 28, and includes a lower surface for sliding engagement with the inner surface of the connector 16, and an upper surface for holding connector 16 radially outward. Connector 16 includes one or more teeth or ridges 30 each for fitting within a respective groove or recess provided in the wellhead. When the connector 16 is in the set position, the outer surface of actuating sleeve 26 in engagement with connector 16 may be a non-tapered surface. FIG. 2 also depicts a plurality of optional debris seals 14 around the body of the bushing. These seals need not seal with the interior of the wellhead housing, but do desirably limit trash in the annulus between the bushing and the wellhead housing. C-ring 22 is provided for retrieval of the wear bushing by engaging shoulder 23, as explained subsequently.

Figure 3:
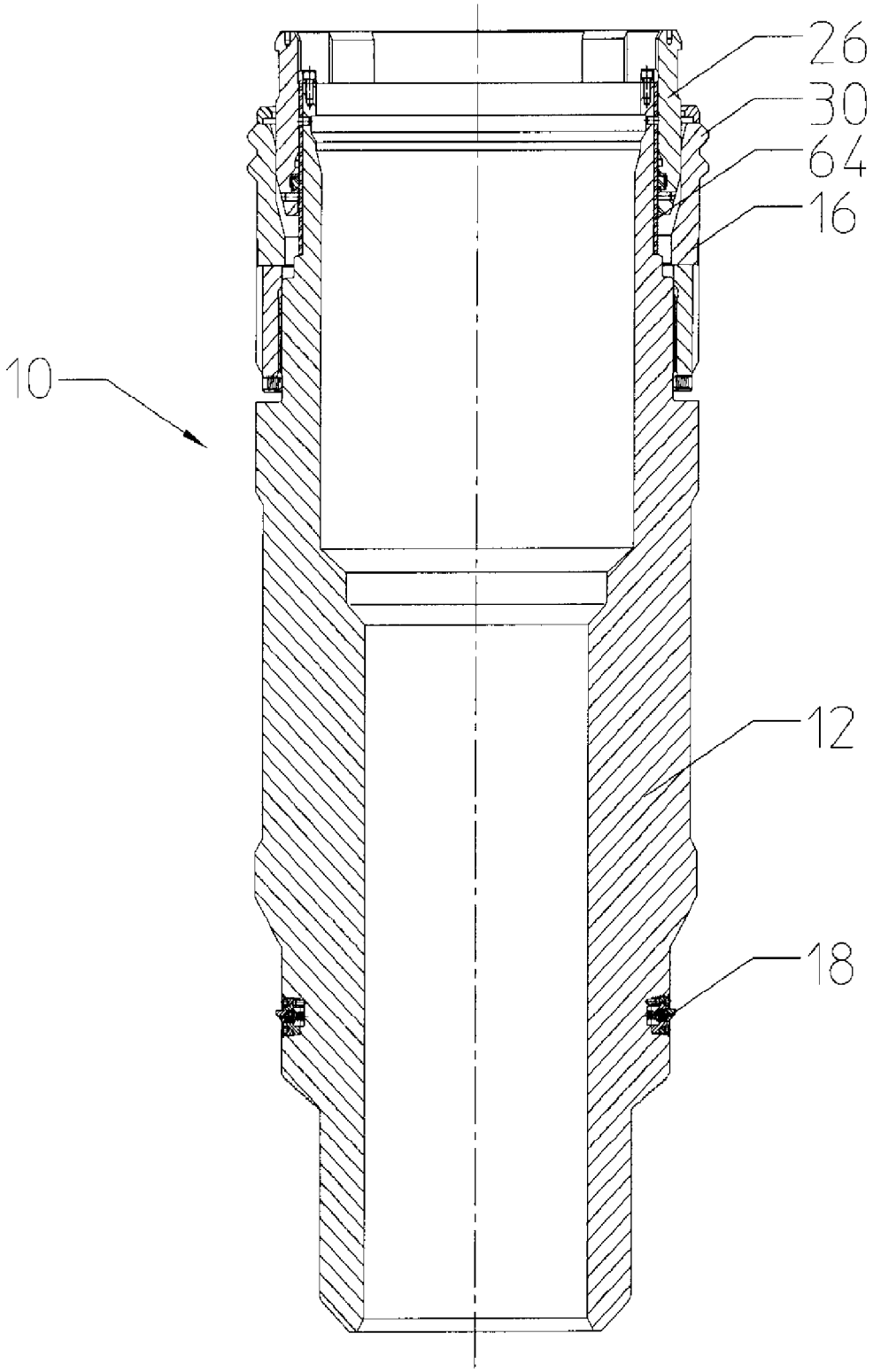

FIG. 3 depicts yet another suitable wear bushing 10 with the latch mechanism 16 having teeth 30 for fitting in the grooves in the wellhead. Sleeve 64 is secured to the body 12 of the wear bushing, and is provided with inner teeth. Further details of this embodiment are discussed below with respect to FIG. 7. Each of the embodiments shown in FIGS. 1-3 uses downward movement of an actuating ring to force latch mechanism 16 radially outward. Each embodiment may also include a casing hanger latch 18 as discussed below. Details regarding techniques for retrieving the wear bushing shown in FIGS. 1 and 3 are also discussed below.

Figure 4:
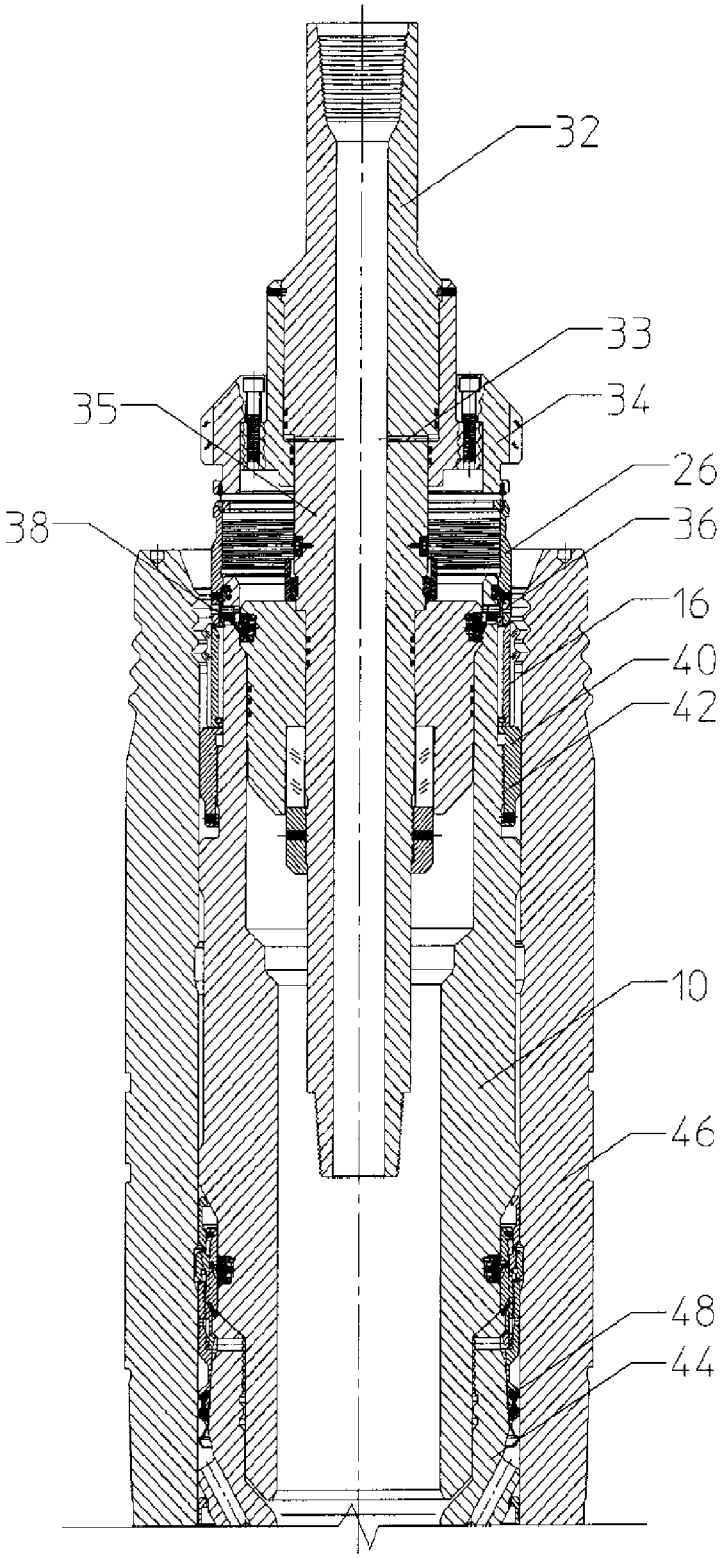
FIG. 4 illustrates the wear bushing shown in FIG. 1 and a sectional view of a running tool landing the wear bushing on a casing hanger.

FIG. 4 depicts the wear bushing 10 as shown in FIG. 1 landed on casing hanger 44, which in turn is landed in wellhead 46 and secured thereto with a conventional casing hanger latch. Seal assembly 48 seals between the casing hanger and the wellhead. The bushing 10 shown in FIG. 4 is not yet connected with the wellhead. FIG. 4 depicts a suitable running tool 32 for actuating the latch mechanism 16. Mandrel 35 of the running tool includes through port 33 such that piston 34 supported on the running tool moves downward in response to fluid pressure within the running tool, thereby moving actuator sleeve 26 downward, and moving connector 16 radially outward. For this embodiment, the body 12 of the bushing includes a recess 38 for receiving connector 36 to interconnect the running tool and the wear bushing as they are lowered into the well.

FIG. 5 shows in greater detail the actuating sleeve 26 pressed downward, thereby forcing the connector latch mechanism or connector 16 radially outward so that the teeth 30 each fit within a respective groove 31 in the wellhead 46. The wear bushing 10 may be axially loaded when secured to the wellhead, but need not be preloaded. In other applications, the wear bushing may be preloaded a selected amount.

The wear bushing as shown in FIG. 5 may be unlocked from the wellhead 46 by a running tool with a split retrieval ring 52, which is moved by a piston on a retrieval tool functionally similar to piston 34 shown in FIG. 4. The retrieval ring 52 is split so that it may expand over the outer lip 54 of the actuator sleeve 26. Once the running tool has landed on the wear bushing, pressure may be increased in the I.D. of the running tool so that the piston moves down and the retrieving ring 52 expands over the lip of the actuating ring until the retrieving ring 52 collapses into the groove 55 at the top of the actuating ring, thereby axially securing the actuating ring and the retrieval ring. The blowout preventer rams above the wellhead may be closed and pressure then applied through choke and kill lines below the rams to force the piston upward. An axially upward pull on the workstring may also be transmitted through the running tool to assist in retrieval. The upward force applied to the actuating ring 26 will shear the small teeth on the split shear ring 56, thereby unlocking the actuating ring from the wellhead. O-rings or the biasing member 62 may urge ring 56 into engagement with mating teeth on sleeve 26. The rams may be then be opened and the wear bushing retrieved. The above technique is the primary unlocking technique for each of the FIG. 5-7 embodiments.

Figure 6:
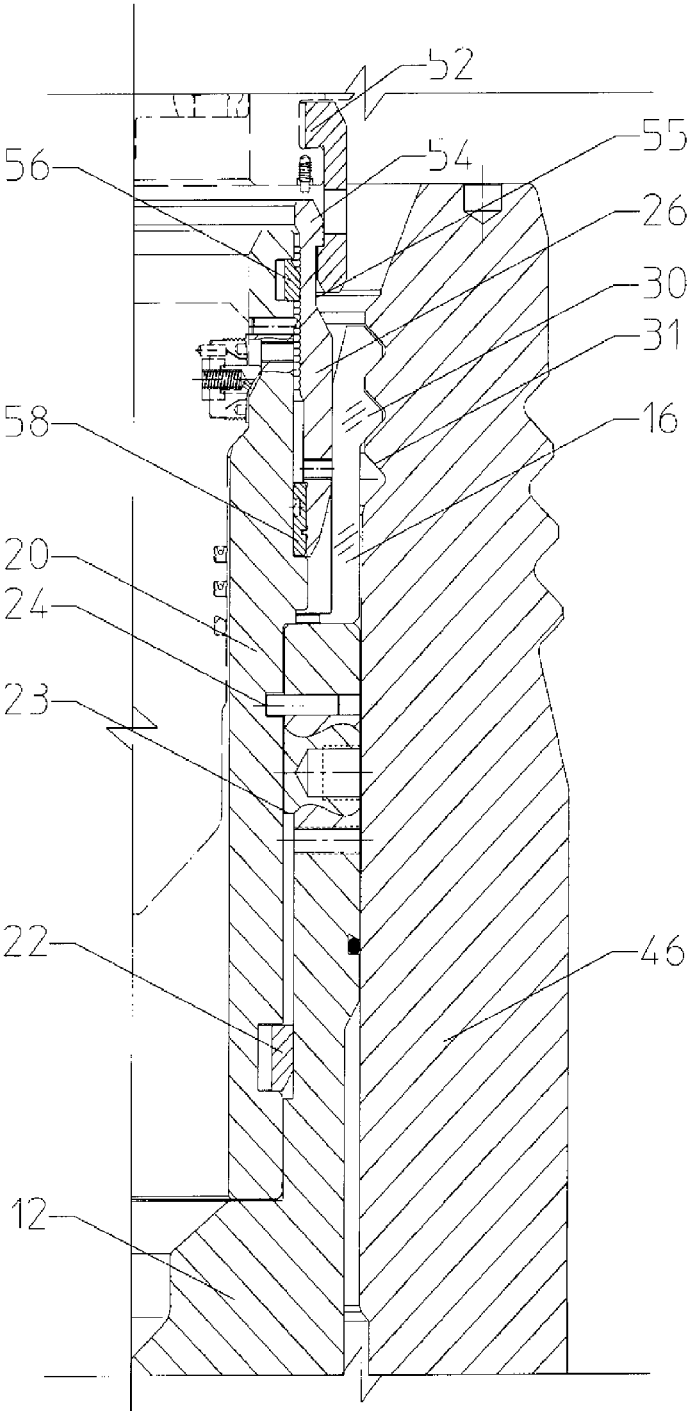

The FIG. 6 embodiment operates with the primary unlocking mechanism similar to that discussed in FIG. 5. FIG. 6 shows in greater detail a portion of the wear bushing 10 shown in FIG. 2, with the connector 16 latched to the internal grooves or recesses 31 in the wellhead 46. As fluid pressure is released in the running tool and the tool is retrieved to the surface, the actuating ring 26 as shown in FIG. 6 remains in its locked position due to ratch latch mechanism 56 connecting the interior sleeve 20 and the actuating sleeve 26. Shear pins 24 prevent upward movement of the sleeve 20 relative to the body 12, but may be sheared to retrieve the wear bushing from the well by pulling upward on the bushing.

If the primary unlock as discussed above is unable to release the FIG. 6 wear bushing, e.g., due to build up of debris in and around the tool, the inner sleeve 20 may serve as an emergency unlock sleeve to unlock the wear bushing from the wellhead. Picking up on the tool with additional force will shear the pin 24, thereby allowing upward movement of the sleeve 20 with respect to the wear bushing 12. During this action, the split ring 22 captured in a groove in sleeve 20 moves upward to engage the shoulder 23 on the wear bushing, so that retrieval of the sleeve 20 also retrieves the wear bushing 12. Latch mechanism 16 is thus allowed to collapse during this upward movement, so that the unlock sleeve and the body of the wear bushing may be retrieved to the surface.

FIG. 6 also depicts a shear ring member 58 which interconnects the actuating sleeve 26 and the inner sleeve 20. In the event that the tool cannot release the wear bushing from the wellhead in one of the manners described above and the retrieval tool cannot be released from the actuating sleeve, a higher upward force on the actuating sleeve will shear the ring 58 and will thereby allow the retrieval of the running tool with the actuating ring, so that other measures may be taken to subsequently retrieve the wear bushing.

Figure 7:
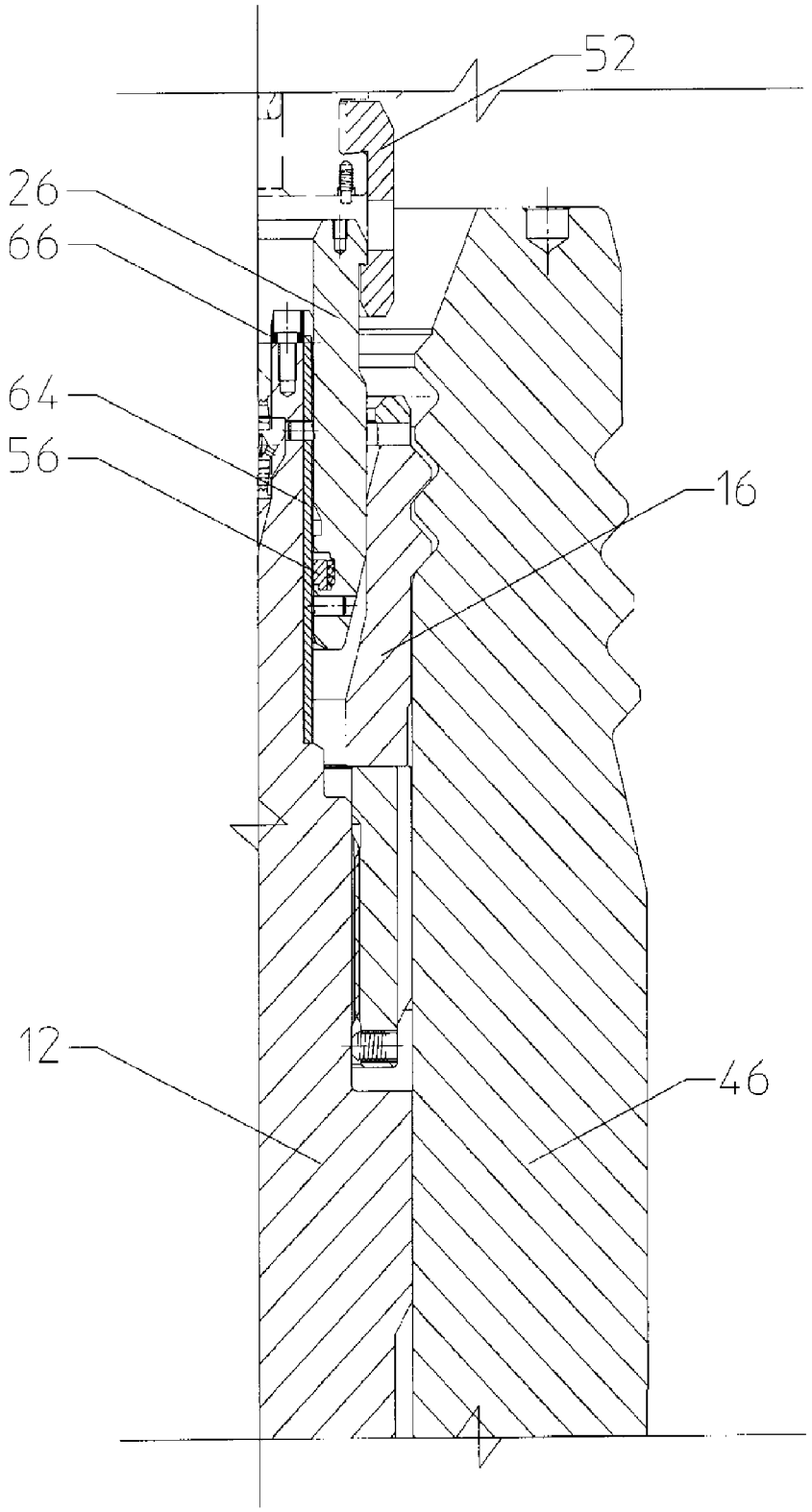

FIG. 7 shows yet another embodiment of a mechanism for retrieving the wear bushing from the wellhead. In this case, retrieving ring 52 connects to the actuating sleeve 26, which connects with teeth on the exterior of sleeve 64 which is pinned to bushing body 12. Split ring 56 carried on the actuator sleeve has outer teeth which mate with teeth on sleeve 64. An upward force applied to the actuating ring 26 through the retrieving ring 52 may be used to pull the actuating ring 26 upward and release the latch mechanism 16. If this force is not sufficient to release the wear bushing, a further upward force applied to the actuating ring will release the upper shear ring segments 66 from the body of the wear bushing 12, so that the sleeve 64 may then be retrieved with the actuating sleeve 26 and the wear bushing 16. Ring segments 66 are thus joined at a plurality of circumferential locations to the body of the wear bushing, and these circumferential connections shear to release ring segments 66 from the body of the wear bushing in response to a predetermined upward force. With actuating sleeve 26 and sleeve 64 moving upward, latch mechanism 16 may move inward, thereby releasing the wear bushing from the wellhead.

Figure 8:
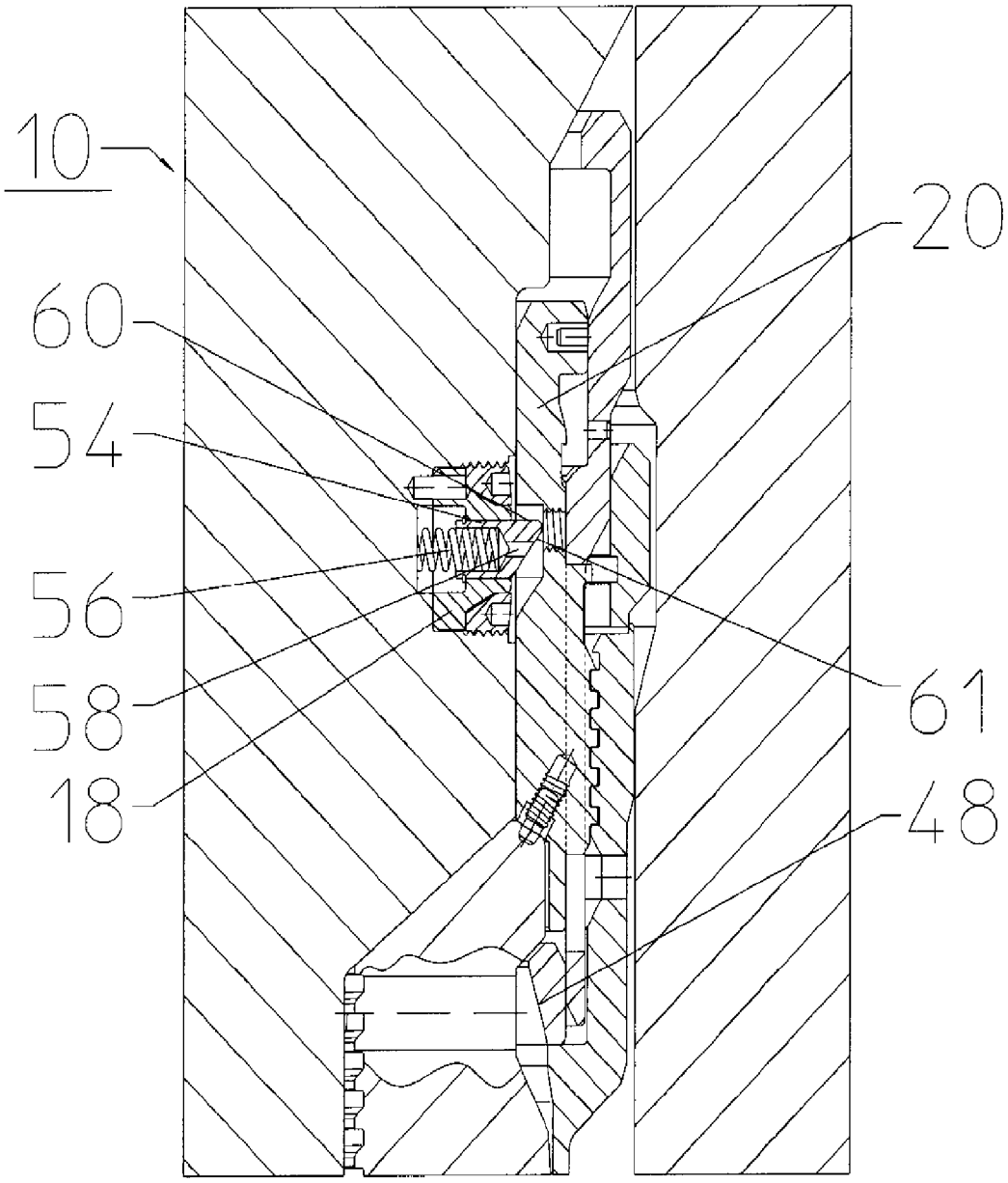
FIG. 8 is a detailed cross-sectional view of a portion of the wear bushing locked to the casing hanger seal assembly.

FIG. 8 shows in greater detail a bushing/casing hanger connector 54 interconnecting the bushing 10 and the inner seal sleeve 20. Latching dog 54 is biased radially outward by spring 56, and includes an aperture 58 for preventing pressure lock. Upper stop surface 60 is provided for planar engagement with the casing hanger seal assembly to prevent upward movement of the wear bushing with respect to the casing hanger, while tapered lower surface 61 allows the dogs 54 to move radially inward when lowered to a final position and the dogs each snap into a groove in the casing hanger.

The embodiment as shown in FIG. 8 secures the wear bushing to casing hanger seal, which in turn is connected to the casing hanger, which is landed on the wellhead. In an alternative wear bushing, the connector 18 may connect a lower portion of the wear bushing directly to the casing hanger body, rather than the casing hanger seal. In still other embodiments, the interconnection of the wear bushing and the wellhead is sufficient to accomplish the desired goals, and the wear bushing may not be interconnected with either the casing hanger or the casing hanger seal.

In the preferred embodiment, the bushing/wellhead housing connector interconnects the bushing with the wellhead by providing a connector with radially movable ridges or teeth that fit within respective slots or recesses in the wall of the wellhead housing. This design is highly preferred over alternative designs that may interconnect the bushing to the wellhead without a connector fitting within grooves or recesses in the interior wall of the wellhead. The bushing/wellhead housing connecter preferably includes a C-ring with axially projecting fingers which include the teeth, although connectors which do not utilize a C-ring may be used.

In a suitable application, a wear bushing may be landed on the casing hanger and serves to minimize damage to the wellhead housing, the casing hanger, and the casing string during rotation of the drill string. The bushings/housing connector axially connects the wear bushing and the wellhead housing, and this is accomplished with a retrievable running tool which forces at least a portion of the connector within a corresponding recess in the interior wall of the wellhead housing. In one application, a lockdown piston on the running tool is axially moved in response to fluid pressure and moves an actuator sleeve downward to force the connector radially outward.

The techniques disclosed herein reliably secure the wear bushing to the wellhead housing, and in most applications an additional trip into the well will be required to activate the bushing/wellhead housing connector compared to embodiments wherein the wear bushing is run into the well with the bottomhole assembly and drill bit, and the wear bushing is not secured to the wellhead housing. The cost of additional trip into the well is worth the benefits, however, that derive from reliably securing the bushing in place to the wellhead housing.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A wear bushing and retrievable running tool for a subsea well assembly including a wellhead housing and a casing hanger within the wellhead housing and supporting a casing string, comprising:

the wear bushing for landing on the casing hanger to minimize damage to the wellhead housing, the casing hanger and the casing string during rotation of a drill string;

a bushing/wellhead housing connector supported on the wear bushing for axially connecting the wear bushing and the wellhead housing;

the retrievable running tool actuated to connect the wear bushing and the wellhead housing with the connector, such that at least a portion of the connector is received with a corresponding recess in an interior wall of the wellhead housing;

wherein the wear bushing includes an inner sleeve connected to a body of the wear bushing by a plurality of shear pins, the shear pins providing a releasable, second connection between the wellhead housing and the wear bushing that allows release of the wear bushing from the wellhead housing in the event the bushing/wellhead housing connector cannot release, the wear busing minimizing damage to the well housing, the casing hanger, and the casing string when the drill string rotates within the wear bushing; and wherein the retrievable running tool includes a piston movable in response to fluid pressure in the running tool to actuate the bushing/wellhead housing connector.

2. A wear bushing and running tool as defined in claim 1, further comprising:

a bushing/casing hanger latch axially interconnecting the wear bushing and the casing hanger.

3. The wear bushing and running tool as defined in claim 2, further comprising:

the bushing/casing hanger latch is biased radially outward by a spring.

4. The wear bushing and running tool as defined in claim 1, further comprising:

a locking member axially interconnecting the running tool and the wear bushing.

5. The wear bushing and running tool as defined in claim 1, further comprising:

the running tool supporting a piston axially moveable with respect to the wellhead; and an actuator sleeve responsive to movement of the piston for forcing the bushing/wellhead housing connector radially outward.

6. The wear bushing and running tool as defined in claim 5, further comprising;

a shear member connecting the actuator sleeve and the wear bushing for preventing axial movement of the actuator sleeve until the shear member is disabled.

7. The wear bushing and running tool as defined in claim 1, further comprising:

the bushing/wellhead housing connector includes a C-ring having a portion received within the corresponding recess in the interior wall of the wellhead housing.

8. The wear bushing and running tool as defined in claim 1, further comprising:

an inner sleeve positioned at least partially within the body of the wear bushing, the inner sleeve being axially movable to release the bushing/wellhead housing connector and retrieve the wear bushing.

9. A wear bushing for a subsea well assembly including a wellhead housing and a casing hanger within the wellhead housing and supporting a casing string, the wear bushing positioned downhole on a running tool, comprising:

the wear bushing for landing on the casing hanger to minimize damage to the wellhead housing, the casing hanger, and the casing string during to rotation of a drill string;

a bushing/wellhead housing connector supported on the wear bushing for axially connecting the wear bushing and the wellhead housing with the connector in response to actuation of the running tool, such that at least a portion of the connector is received with a corresponding recess in an interior wall of the wellhead housing;

wherein the wear bushing includes an inner sleeve connected to a body of the wear bushing by a plurality of shear pins, the shear pins providing a releasable, second connection between the wellhead housing and the wear bushing that allows release of the wear bushing from the wellhead housing in the event the bushing/wellhead housing connector cannot release, the wear busing minimizing damage to the well housing, the casing hanger, and the casing string when the drill string rotates within the wear bushing; and wherein the running tool includes a piston movable in response to fluid pressure in the running tool to actuate the bushing/wellhead housing connector.

10. The wear bushing as defined in claim 9, further comprising:

a bushing/casing hanger latch axially interconnecting the wear bushing and the casing hanger.

11. The wear bushing as defined in claim 9, further comprising:

an actuator sleeve responsive to actuation of the running tool for forcing the bushing/wellhead housing connector radially outward.

12. The wear bushing as defined in claim 11, further comprising:

a shear member for preventing axial movement of the actuator sleeve until the shear member is disabled.

13. The wear bushing as defined in claim 9, further comprising:

an inner sleeve positioned at least partially within the body of the wear bushing, the sleeve being axially movable to release the bushing/wellhead housing connector and retrieve the wear bushing.

14. A method of minimizing wear within a subsea well assembly including a wellhead housing, and a casing hanger within the wellhead housing and supporting a casing string, the method comprising:

landing a wear bushing on the casing hanger to minimize damage to the wellhead housing, the casing hanger, and the casing string during rotation of a drill string;

rotating the drill string within the wear bushing;

providing a connector for axially connecting the wear bushing and the wellhead housing;

actuating a running tool to connect the wear bushing and the wellhead housing with the connector, such that at least a portion of the connector is received within a corresponding recess in an interior wall of the wellhead housing;

wherein the wear bushing includes an inner sleeve connected to a body of the wear bushing by a plurality of shear pins, the shear pins providing a releasable, second connection between the wellhead housing and the wear bushing that allows release of the wear bushing from the wellhead housing in the event the connector cannot release, the wear busing minimizing damage to the well housing, the casing hanger, and the casing string when the drill string rotates within the wear bushing; and wherein the running tool includes a piston movable in response to fluid pressure in the running tool to actuate the bushing/wellhead housing connector.

15. The method as defined in claim 14, further comprising:

axially interconnecting the wear bushing and the casing hanger.

16. The method as defined in claim 14, further comprising:

supporting a lockdown piston on the running tool axially moveable with respect to the wellhead; and providing an actuator sleeve responsive to movement of the lockdown piston for forcing the connector radially outward.

17. The method as defined in claim 16, further comprising:

preventing axial movement of the actuator sleeve with a shear member connecting the actuator sleeve and the wear bushing until the shear member is disabled.

18. The method as defined in claim 14, further comprising:

axially interconnecting the wear bushing and the running tool when the wear bushing is run in the well.

19. The method as defined in claim 14, wherein the bushing/wellhead housing connector includes a C-ring.

* * * * *